US008966847B2

(12) United States Patent
Kessler et al.

(10) Patent No.: US 8,966,847 B2
(45) Date of Patent: Mar. 3, 2015

(54) FLOOR MAT SYSTEM AND DIVIDER FOR USE THEREWITH

(71) Applicant: R&L Marketing & Sales, Inc., Youngstown, OH (US)

(72) Inventors: Daniel A. Kessler, Girard, OH (US); David M. Neill, Canfield, OH (US); Thomas J. Bobonick, Austintown, OH (US); Shawn P. Dockry, Austintown, OH (US); Ronald N. Kessler, Girard, OH (US)

(73) Assignee: R&L Marketing & Sales, Inc., Youngstown, OH (US)

( * ) Notice: Subject to any disclaimer, the term of this patent is extended or adjusted under 35 U.S.C. 154(b) by 0 days.

(21) Appl. No.: 14/046,053

(22) Filed: Oct. 4, 2013

(65) Prior Publication Data

US 2014/0053490 A1 Feb. 27, 2014

Related U.S. Application Data

(63) Continuation-in-part of application No. 13/594,926, filed on Aug. 27, 2012, now Pat. No. 8,572,919.

(51) Int. Cl.
*E04C 2/38* (2006.01)
*E04B 1/68* (2006.01)

(52) U.S. Cl.
CPC ..... *E04B 1/6804* (2013.01)
USPC ..... 52/466; 52/395; 52/396.04; 52/402; 52/467

(58) Field of Classification Search
USPC ..... 52/467, 402, 395, 396.04, 466, 464, 52/458, 718.04, 718.01, 718.06, 718.05, 52/179, 459
See application file for complete search history.

(56) References Cited

U.S. PATENT DOCUMENTS

| | | | | |
|---|---|---|---|---|
| 4,066,285 | A * | 1/1978 | Hall et al. | 293/120 |
| 4,067,155 | A * | 1/1978 | Ruff et al. | 52/105 |
| 4,736,563 | A | 4/1988 | Bilhorn | |
| 4,893,449 | A * | 1/1990 | Kemper | 52/464 |
| 5,353,571 | A * | 10/1994 | Berdan et al. | 52/716.5 |
| 5,657,598 | A | 8/1997 | Wilbs et al. | |
| 5,939,670 | A | 8/1999 | Shteynberg et al. | |
| 6,345,480 | B1 | 2/2002 | Kemper et al. | |
| 6,523,986 | B1 * | 2/2003 | Hoffmann | 362/576 |
| 6,550,205 | B2 | 4/2003 | Neuhofer, Jr. | |
| 6,588,165 | B1 * | 7/2003 | Wright | 52/506.05 |
| D574,975 | S * | 8/2008 | Neuhofer, Jr. | D25/164 |
| 7,797,900 | B2 | 9/2010 | Sondermann | |
| 8,266,865 | B2 | 9/2012 | Neuhofer, Jr. | |

(Continued)

*Primary Examiner* — Basil Katcheves
*Assistant Examiner* — Joshua Ihezie
(74) *Attorney, Agent, or Firm* — Sand & Sebolt

(57) ABSTRACT

A flooring system and a divider for use therewith which transitions between a first and second flooring surface. The divider includes first and second members that snap-fittingly engage each other. A protrusion with a curved terminal end extends from the first member is received in a recess in the second member. The protrusion enables the first member to pivot relative to the second member. A second protrusion extends outwardly from the first member and into a second recess in the second member. A pair of arms extends outwardly in opposite directions from a central base region on the first member and beyond the sides of the second member. In one embodiment, the arms are of the same length and are disposed generally at right angles to the protrusions. In another embodiment a leg extends downwardly from a longer one of the arms to provide extra support to that arm.

28 Claims, 11 Drawing Sheets

(56) References Cited

U.S. PATENT DOCUMENTS

| | | | | |
|---|---|---|---|---|
| 2002/0050109 | A1 | 5/2002 | Grosjean | |
| 2002/0095895 | A1 | 7/2002 | Daly et al. | |
| 2003/0051426 | A1* | 3/2003 | Kornfalt | 52/396.1 |
| 2006/0272269 | A1* | 12/2006 | Bannister | 52/718.01 |
| 2007/0137129 | A1 | 6/2007 | Sondermann | |
| 2008/0034696 | A1* | 2/2008 | Neuhofer | 52/466 |
| 2012/0042596 | A1* | 2/2012 | Schacht et al. | 52/459 |
| 2012/0186171 | A1* | 7/2012 | Sondermann | 52/179 |
| 2013/0061548 | A1* | 3/2013 | Plenet et al. | 52/466 |

* cited by examiner

10

FLOOR MAT SYSTEM AND DIVIDER FOR USE THEREWITH

CROSS-REFERENCE TO RELATED APPLICATION

This is a Continuation-in-Part of U.S. patent application Ser. No. 13/594,926, filed Aug. 27, 2012, the entire specification of which is incorporated herein by reference.

BACKGROUND OF THE INVENTION

1. Technical Field

This invention relates generally to flooring systems. More particularly, this invention relates to flooring systems that encompass two flooring surfaces that are butted up against each other along a joint. Specifically, this invention is directed to a flooring system and a divider used therewith to transition over the joint. The divider includes first and second members that are engaged with each other. The second member is permanently secured to a base surface beneath the two flooring surfaces. The first member is rotatable relative to the second member between a first position where it locks one of the flooring surfaces in place and a second position where it is disengaged from that flooring surface and the flooring surface may be removed for cleaning and/or replacement.

2. Background Information

It is frequently necessary to utilize more than one type of flooring in a building. Wherever two different types of flooring are laid adjacent each other in end-to-end relationship, there may be created an aesthetically displeasing joint between the flooring types. This is especially true of situations where one of the flooring types is raised relative to the other.

It is known in the art to place a transition piece between the two surfaces. Typically the transition piece will be permanently secured to a base surface, such as a concrete pad or wooden subfloor, in a gap between the two flooring surfaces. Each side of the transition may be butted up against an end of one of the flooring surfaces. Alternatively, one side of the transition may be butted up against an end of one of the flooring surfaces, and a region of the transition will overlap the end of the other flooring surface. Previously known devices have made it extremely difficult to remove one of the flooring surfaces, for cleaning purposes, for example. Instead, it has been necessary in the past to clean the flooring surfaces in situ.

There is therefore a need in the art for an improved transition device or divider for a flooring system that will enable the user to quickly and easily remove one of the flooring surfaces for cleaning or replacement, and which will enable that flooring surface to be easily reengaged in the flooring system when the cleaning is completed.

BRIEF SUMMARY OF THE INVENTION

A flooring system and a divider for use therewith. The divider transitions between a first and a second flooring surface and includes a first member and a second member that are snap-fittingly engageable with each other. The second member is permanently secured to a base surface upon which the first and second flooring surfaces are disposed. A protrusion from the first member is received in a recess in the second member. The protrusion has a curved terminal end which enables the first member to pivot relative to the second member. In a first position a lower surface of the first member is parallel to a lower surface of the second member. In a second position, the lower surface of the first member is angled relative to the lower surface of the second member. A second protrusion preferably extends outwardly from the first member and into a second recess in the second member. The first and second protrusions and recesses ensure that the first and second members securely engage each other.

A pair of arms or flanges extends outwardly in opposite directions from a central base region on the first member. In one embodiment, the arms/flanges are of the same length and are disposed generally at right angles to the protrusions. In another embodiment a leg extends downwardly from a longer one of the arms/flanges to provide extra support to that arm/flange. The arms/flanges extend laterally outwardly beyond a side surface of the second member when the first and second members are engaged. The arms/flanges abut the upper surface of the adjacent one of the first and second flooring surfaces. This engagement substantially prevents the one of the first and second flooring surfaces from being lifted off the base surface and also hides the join between the divider and that flooring surface. When the first member is moved to the second position, the arm/flange no longer engages the flooring surface adjacent the one end of the divider. Consequently, that adjacent flooring surface may be removed from the base surface. When the cleaned flooring surface is placed back onto the base surface, the first member is rotated back to the first position so that the flange once again secures it against movement.

In accordance with one aspect of the invention, the flooring system comprises:

- a first flooring surface that is adapted to be positioned upon a base surface;
- a second flooring surface adapted to be positioned on the base surface in end-to-end relationship with the first flooring surface and separated therefrom by a gap; and
- a divider positionable in the gap to provide a transition from the first flooring surface to the second flooring surface; and wherein the divider comprises:
  - a first member; and
  - a second member adapted to be secured to the base surface; wherein the first member is releasably securable to the second member.

In accordance with another aspect of the invention, the flooring system comprises:

- a first flooring surface adapted to be positioned upon a base surface;
- a second flooring surface adapted to be positioned on the base surface in end-to-end relationship with the first flooring surface and separated therefrom by a gap; and
- a divider kit for transitioning the gap between the first and second flooring surfaces; and wherein the kit comprises:
  - a plurality of first members, each of the first members having a different cross-sectional shape;
  - a second member adapted to be secured to the base surface; wherein one of the plurality of first members is selected for engagement with the second member to suit the first and second flooring surfaces to be installed on the base surface; and wherein the selected one of the first members is releasably securable to the second member.

BRIEF DESCRIPTION OF THE SEVERAL VIEWS OF THE DRAWINGS

A preferred embodiment of the invention, illustrated of the best mode in which Applicant contemplates applying the principles, is set forth in the following description and is shown in the drawings and is particularly and distinctly pointed out and set forth in the appended claims.

Similar numbers refer to similar parts throughout the drawings.

DETAILED DESCRIPTION OF THE INVENTION

Figure 1:
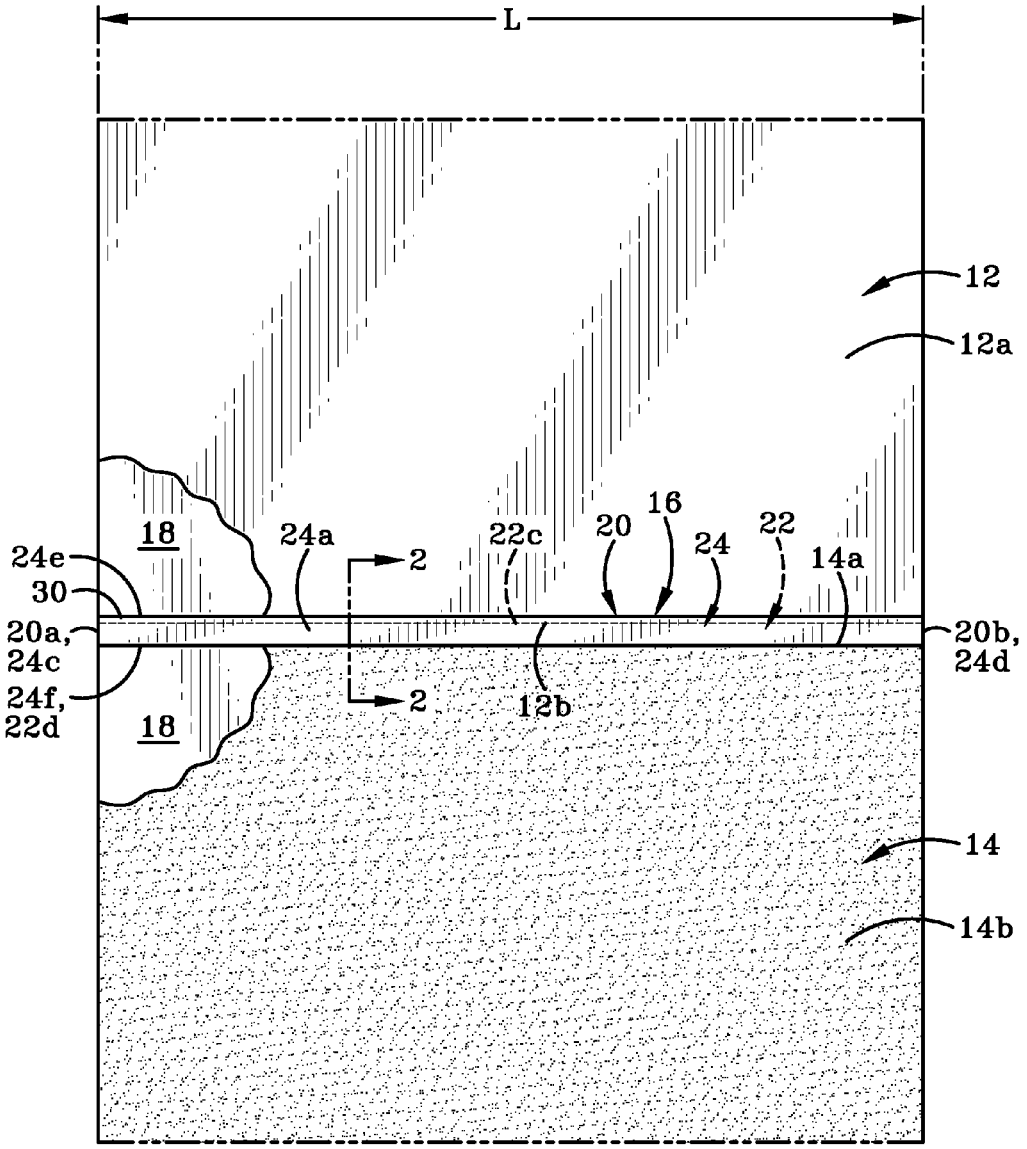
FIG. 1 is a top view of a flooring system incorporating the divider in accordance with the present invention.
Figure 2:
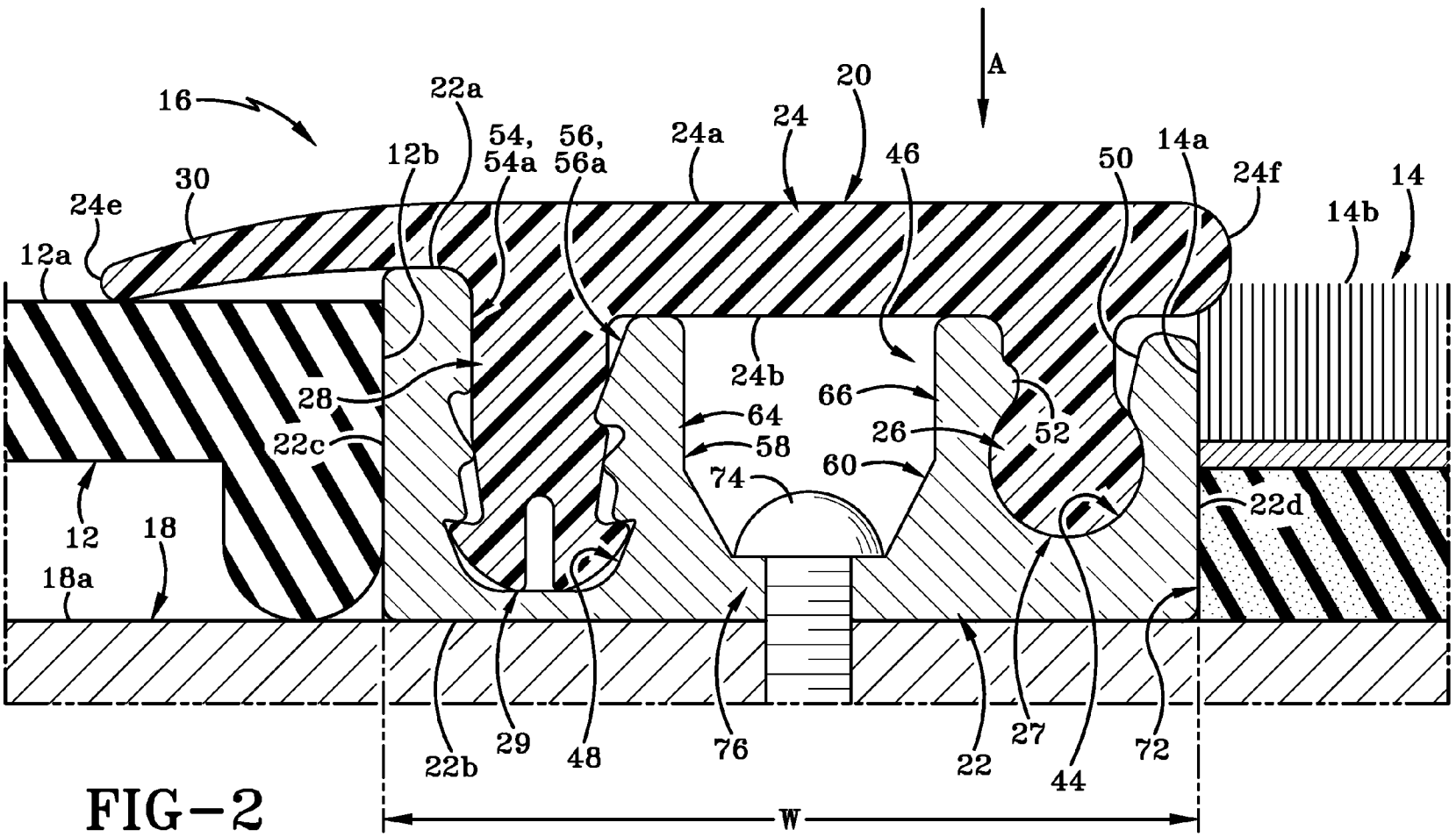
FIG. 2 is a cross-sectional side view of the floor system taken through line 2-2 of FIG. 1.

Referring to FIGS. 1 and 2 there is shown a floor system in accordance with the present invention, generally indicated at 10. Floor system 10 comprises a first flooring surface 12 and a second flooring surface 14 that are disposed in adjacent end-to-end relationship with each other, and a divider 16 that transitions a gap between the two surfaces together. Each of the first and second flooring surfaces 12, 14 is positioned on top of a base surface 18 that does not form part of the floor system 10. The base surface 18 comprises a concrete pad or wooden subfloor, for example and, preferably, divider 16 is placed directly onto upper surface 18*a* (FIG. 2) of base surface 18. It will be understood, however, that alternatively, divider 16 may be placed at least partially within a groove (not shown) formed in upper surface 18*a* of base surface 18. In the latter instance, the upper surface 22*a* of second member 22 of divider 16 may sit substantially flush with upper surface 18*a* or may extend for a distance either above or below upper surface 18*a*.

In accordance with a specific feature of the present invention, first and second flooring surfaces 12, 14 are dissimilar from each other in one or more respects. For example, as illustrated in FIG. 2, first floor surface 12 comprises a rubber mat and second floor surface 14 comprises a carpet. First and second floor surfaces 12, 14 may be made of the same materials but may of different thicknesses or heights relative to base surface 18.

In accordance with yet another specific feature of the present invention, divider 16 comprises a first member 20 and a second member 22 that are interlockingly engaged with each other. First member 20 is an elongate member having a first end 20*a* and second end 20*b*. First member 20 includes an elongate base 24, a first protrusion 26, and a second protrusion 28. Base 24 has a top surface 24*a*, a bottom surface 24*b*, a first end 24*c*, a second end 24*d*, a first side 24*e* (FIG. 2) and a second side 24*f*. First and second ends 24*c*, 24*d* form first and second ends 20*a*, 20*b* of first member 20.

Figure 4:
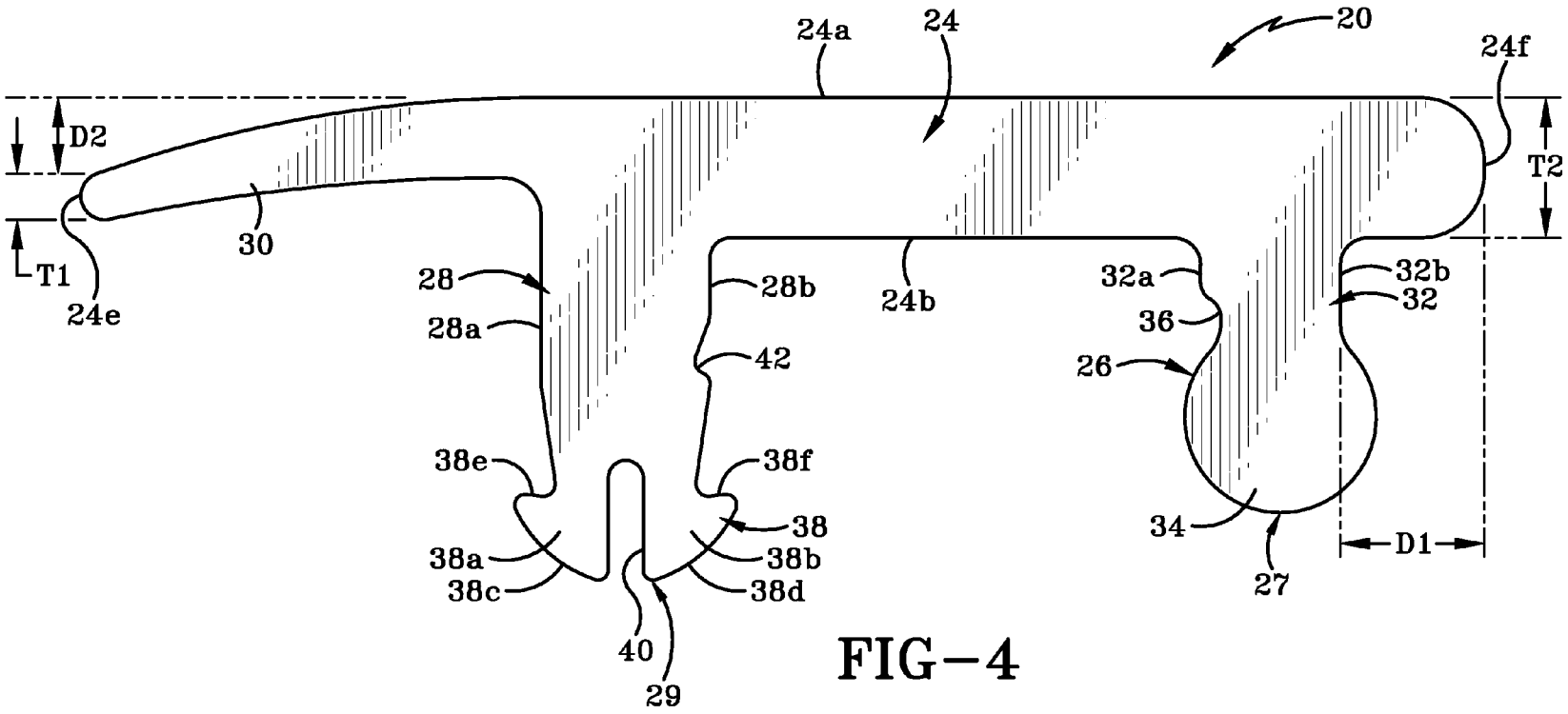
FIG. 4 is a side view of the first member of the divider.

As best seen in FIG. 4, base 24 is not the same thickness between first side 24*e* and second side 24*f*. Instead, base 24 is of a first thickness 71" at first side 24*e* and is of a second thickness 72" at second side 24*f*. First protrusion 26 and second protrusion 28 extend outwardly away from bottom surface 24*b* and are spaced laterally from each other along bottom surface 24*b*. First and second protrusions 26, 28 are generally parallel to each other and are disposed at right angles to bottom surface 24*b* of base 24. In accordance with a specific feature of the present invention, first and second protrusions 26, 28 preferably run the entire length "L" of base 24, from first end 24*c* to second end 24*d*. Preferably, first and second protrusions 26, 28 are substantially continuous along the length "L". It will be understood however that first and second protrusions 26, 28 could be sectioned into smaller, spaced apart first and second protrusion elements that are disposed along the length of base 24 without departing from the scope of the present invention. In that instance, each of the first and second protrusion elements would be of a substantially reduced length relative to length "L" and the elements would preferably be aligned with each other along the length "L", although staggering them across the width "W1" (FIG. 2) would also be possible.

Base 24 is of a substantially constant thickness "T2" from second side 24*f* through to the first side surface 28*a* of second protrusion 28. Beyond first side surface 28*a* the thickness of base 24 tapers gently until it is of a thickness "T1". The portion of base 24 which extends between first side surface 28*a* of second protrusion 28 and first side 24*e* forms a flange 30, the purpose of which will be described further herein. As is evident from FIG. 4, flange 30 tends to angle downwardly away from a plane aligned with top surface 24*a* of base to the degree that first side 24*e* of base 24 is disposed a distance "D2" from the plane aligned with first side 24*e*. Flange 30 is also tapered from adjacent second protrusion 28 to first side 24*e*.

Referring to FIG. 4, it may be seen that first protrusion 26 is spaced a first distance "D1" inwardly from second side 24*f* of base 24 and includes a stem 32 and a terminal end 34. Stem 32 extends outwardly from bottom wall 24*b* of base 24 and terminal end 34 is disposed remote from bottom wall 24*b*. Stem 32 has a first side surface 32*a* and a second side surface 32*b*. First side surface 32*a* defines a notch 36 in a location adjacent terminal end 34. Second side surface 32*b* of stem is substantially straight and unbroken. Terminal end 34 has a curved peripheral surface and first member 20 pivots on this curved surface when it is moved between the first and second positions, as will be hereinafter described. Preferably, terminal end 34 is generally circular in cross-sectional shape and the diameter of terminal end 34 is greater than the width of stem 32 between first and second side surfaces 32*a*, 32*b*.

Second protrusion 28 has a first side surface 28*a* and a second side surface 28*b*. Second protrusion 28 terminates in a tip 38 comprised of a first flange 38*a* and a second flange 38*b* which are mirror images of each other. First flange 38*a* extends outwardly from second protrusion 28 in a first direction and second flange 38*b* extends outwardly from second protrusion 28 in a second direction. A slot 40 is defined between first and second flanges 38*a*, 38*b* and slot 40 is oriented substantially at right angles to lower surface 24*b* of base 24. Flanges 38*a*, 38*b* each extend for a distance outwardly beyond the associated one of first and second side surfaces 28*a*, 28*b*. First flange 38*a* is provided with a first curved outer surface 38*c* and a shoulder 38*e*. Second flange 38*b* is provided with a second curved surface 38*d* and a shoulder 38*f*. Curved outer surfaces 38*c*, 38*d* aid in helping first member 20 to rotate relative to second member 22, as will be hereinafter described. Shoulders 38*e*, 38*f*, are positioned adjacent the respective one of first and second side surfaces 28*a*, 28*b* and are disposed generally at right angles thereto.

FIG. 4 shows that first side surface 28*a* of second protrusion 28 is substantially flat between its origin in lower surface 24*b* of base and where it joins shoulder 38*e*. Second side surface 28*b* includes a notch 42 defined approximately halfway between second side surface 2813's origin in lower surface 24*b* of base 24 and its termination in shoulder 38*f*.

Figure 5:
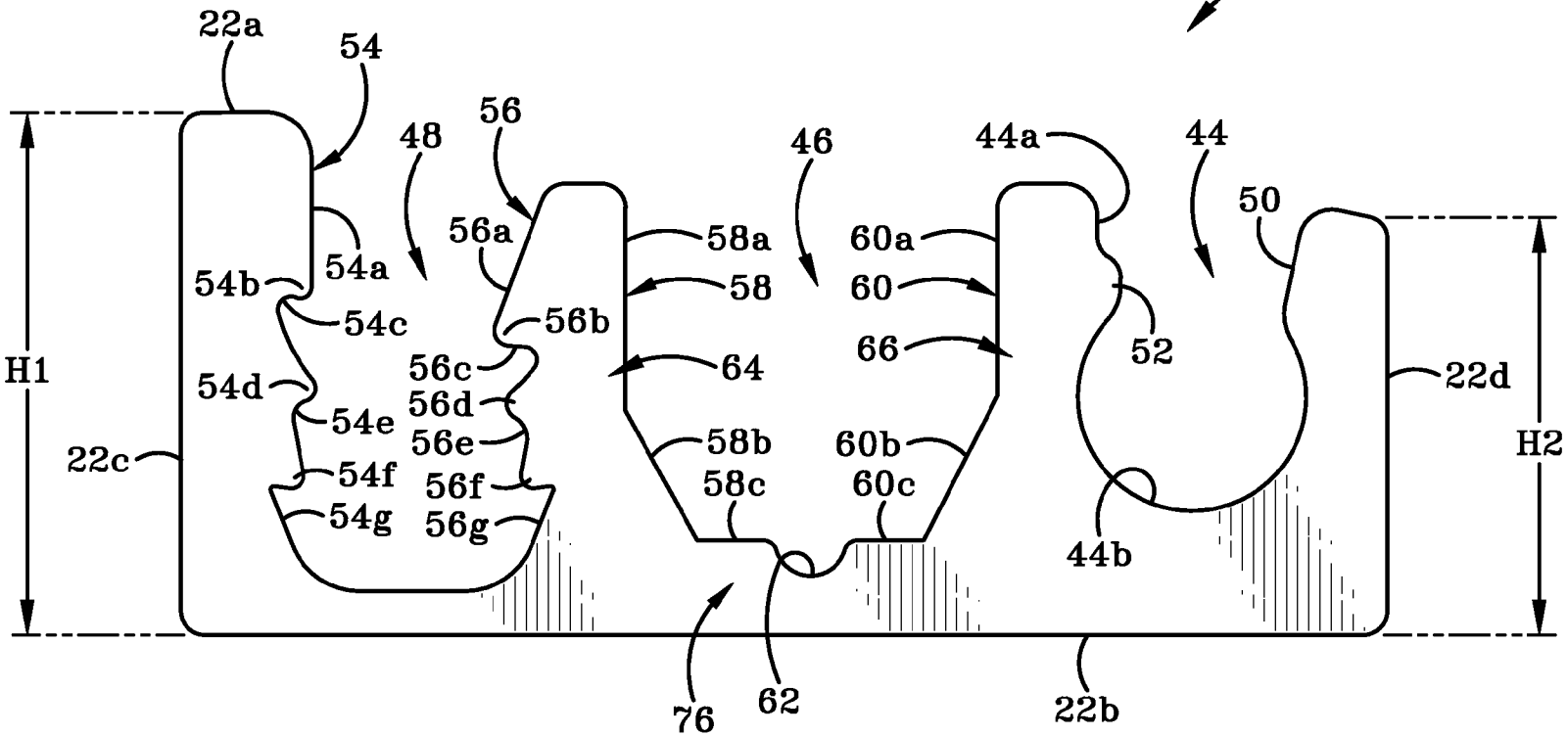
FIG. 5 is a side view of the second member of the divider.
Figure 6:
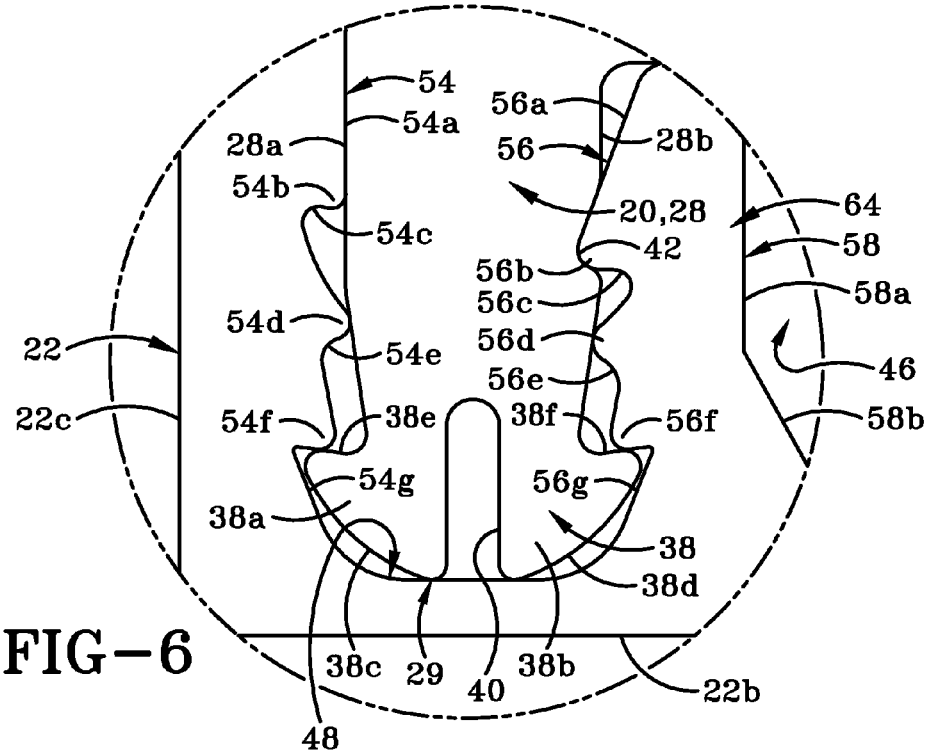
FIG. 6 is an enlarged view of the first highlighted region of FIG. 3.
Figure 7:
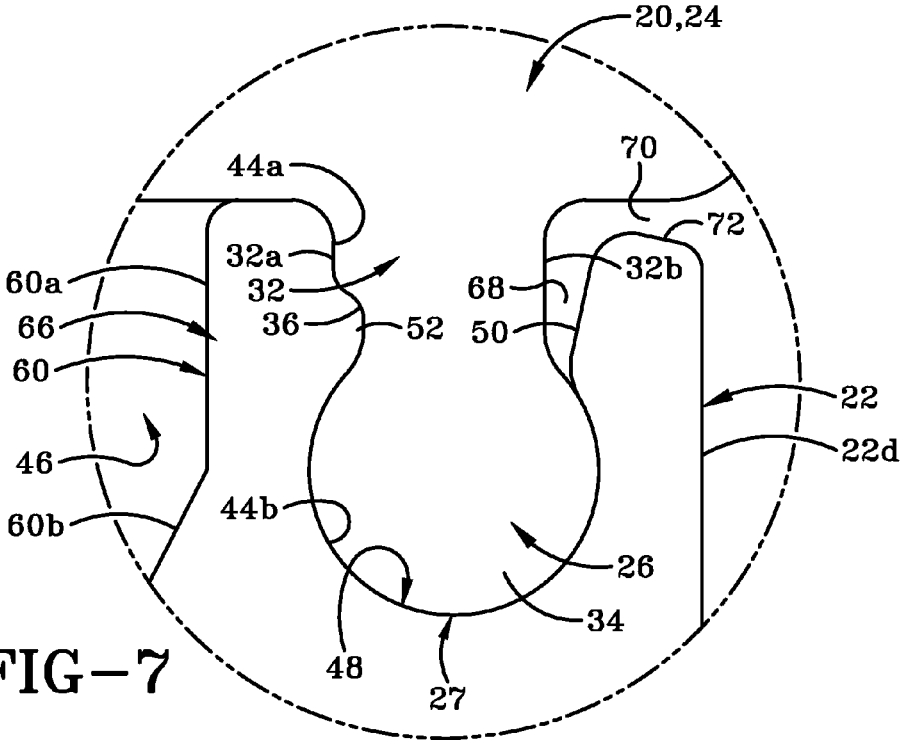
FIG. 7 is an enlarged side view of the second highlighted region of FIG. 3.

FIG. 5 shows second member 22 in greater detail. It will be understood that second member 22 preferably is configured to have a length "L" that is substantially equal to that of first member 20 and has ends (not shown) that are substantially aligned with ends 20*a*, 20*b*. Preferably, second member is substantially continuous between first and second ends 20*a*, 20*b*. It will, however, be understood that smaller individual second member sections (not shown) may be placed in spaced apart longitudinal alignment with each other to engage a substantially continuous first member 20 of length "L". The arrangement of first and second protrusions 26, 28 and recesses in second member 22 that will be described hereafter may be of a variety of configurations but the configuration in first member 20 and second member 22 is complementary.

Second member 22 comprises an upper surface 22*a*, a lower surface 22*b*, a first side 22*c* and a second side 22*d*. First side 22*c* is of a first height "H1" and second side 22*d* is of a second height "H2". As is evident from FIG. 5, second height "H2" preferably is smaller than first height "H1" and upper surface 22*a* therefore slopes downward from first side 22*c* to second side 22*d*. This difference in height aids in permitting first member 20 to pivot relative to second member 22. First and second sides 22*c*, 22*d* preferably are disposed substantially at right angles to lower surface 22*b*.

In accordance with a specific feature of the present invention second member 22 defines a first, second and third recess 44, 48, and 46 in upper surface 22*a*. First recess 44 is configured to be substantially complementary to first protrusion 26 on first member 20. First recess 44 is substantially identically shaped to first protrusion 26 and includes a stem channel 44*a* and a terminal end channel 44*b*. Stem channel 44*a* differs from stem 32 by including a face 50 that is disposed at a first angle greater than 90° relative to lower surface 22*b*. The first angle preferably is about 100° relative to lower surface 22*b*. This face 50 provides for easier insertion of first protrusion into first recess and easier removal therefrom, as will be hereinafter described. Face 50 also is angled to enable first member 20 to pivot relative to second member 22. A detent 52 extends into first recess 44 in a location that corresponds to notch 36 in first protrusion 26. Detent 52 is engaged in notch 36 to interlockingly secure first protrusion 26 in first notch 44 and thereby lock first member 20 to second member 22 and prevent their disengagement. Detent 52 is engaged in notch 36 when first member 20 is in a first position substantially parallel to lower surface 22*b* of second member 22. Detent 52 is disengaged from notch 36 when first member 20 is moved to a second position where first member 20 is pivoted so as to be disposed at an angle relative to lower surface 22*b* of second member 22. The wall defining first recess 44 includes a curved bottom surface that is complementary to terminal end 34 on first protrusion 26. This curvature enables first member 20 to pivot relative to second member 22. When first member 20 is in the second position it may be completely detached from second member 22 by pulling first member 20 outwardly away from second member 22, as will be hereinafter described. It will be understood that the detent 52 may be formed on the first protrusion 26 and the notch 36 defined in the wall which defines first recess 44 without departing from the scope of the present invention.

Second recess 48 is configured to be substantially complementary to second protrusion 28 on first member 20. Second recess 48 is defined by the surrounding wall of second member 22 to have a first face 54 that will engage first side surface 28*a* of second protrusion 28 and a second face 56 that will engage second surface 28*b* of second protrusion 28. First face 54 includes a first section 54*a*, a first detent 54*b*, a first notch 54*c*, a second detent 54*d*, a second notch 54*e*, a third detent 54*f* and a fourth notch 54*g*. First section 54*a* is disposed generally perpendicular to lower surface 22*b* and parallel to first side 22*c* of second member 22. Fourth notch 54*g* is substantially complementary shaped to first flange 38*a* of second protrusion 38*a*. The arrangement of first, second and third detents 54*b*, 54*d*, and 54*f* is such that their upper surfaces slope downwardly so as to guide second protrusion 28 deeper into second recess 48 when first and second members 20, 22 are engaged with each other. The curvature of the lower surfaces of first, second, and third detents 54*b*, 54*d*, and 54*f* is such that they tend to guide first flange 38*a* into the adjacent respective one of the first and second notches 54*c*, 54*e* when second protrusion 28 with withdrawn from second recess 48.

Second face 56 of second recess 48 is configured to include a first face 56*a*, a first detent 56*b*, a first notch 56*c*, a second detent 56*d*, a second notch 56*e*, a third detent 56*f*, and a third notch 56*g*. First face 56*a* is disposed at a second angle relative to lower surface 22*b*. The second angle is about 110° relative to lower surface 22*b*. Again, first face 56*a* is disposed at the second angle so that second protrusion 28 may slide easily into second recess 48 and may be relatively easily withdrawn therefrom. First, second, and third detents, 56*b*, 56*d*, and 56*f* have upper surfaces that slope downwardly toward lower surface 22*b* and thereby tend to guide second protrusion 28 deeper into second recess 48. First, second and third detents 56*b*, 56*d*, and 56*e* have lower surfaces that slope upwardly and thereby tend to guide the shoulder regions 38*e*, 38*f* of first and second flanges 38*a*, 38*b* into second and first notches 56*e*, 56*c* as second protrusion 28 is withdrawn from second recess 48. Third notch 56*g* is substantially complementary in shape to second flange 38*b*.

In accordance with a specific feature of the present invention, first notches 54*b*, 56*b* are offset vertically relative to each other by a small distance. Similarly, first detents 54*c*, 56*c* are offset vertically relative to each other; second notches 54*c*, 56*c* are offset vertically relative to each other; second detents 54*d*, 56*d* are offset vertically relative to each other by a smaller distance, and third detents 54*f*, 56*f* are substantially vertically and horizontally aligned with each other. This arrangement enables the pivoting motion of first member 20 to occur. Additionally, the configuration of the bottom region of second recess 48 is such that first and second flanges 38*a*, 38*b* are not tightly retained therein but, instead, first and second flanges 38*a*, 38*b* are free to move within this bottom region when first member 20 is pivoted between the first and second positions.

When second protrusion 28 is moved into or withdrawn from second recess 48 when first and second members 20, 22 are engaged or disengaged, first and second flanges 38*a*, 38*b* flex inwardly toward each other as they sequentially encounter first detents 54*b*, 56*b*; second detents 54*d*, 56*d*; and third detents 54*f*, 56*f*. This is made possible by the presence of slot 40 between first and second flanges 38*a*, 38*b*. Once flanges 38*a*, 38*b* clear the detents, they tend to spring back to their original position and become locked into the adjacent notches. So, for example, when second protrusion 28 is moved into second recess 48 and flanges 38*a*, 38*b* clear second detents 54*d*, 56*d*, the flanges will spring outwardly away from each other and become engaged in second notches 54*e*, 56*e*. When flanges 38*a*, 38*b* subsequently clear third detents 54*f*, 56*f* they will spring outwardly away from each other and become engaged in third notches 54*g*, 56*g*. When second protrusion 28 is withdrawn from second recess 48 and flanges 38*a*, 38*b* clear third detents 54*f*, 56*f* they will become engaged in second notches 54*e*, 56*e*; and when they clear second detents 54*d*, 56*d* they will become engaged in first notches 54*c*, 56*c*.

It should be noted that when second protrusion 28 is withdrawn from second recess 48 it has to be tilted at an angle to clear the various detents. This angular arrangement is facilitated by the offset arrangement between the pairs of detents 54*b*, 56*b*; 54*d*, 56*d*; and 54*f*, 56*f* and the pairs of notches 54*c*, 56*c* and 54*e*, 56*e*. The angular orientation of face 56*a* also ensures that second protrusion 28 is able to rotate through the required angle to disengage it from second recess 48.

Third recess 46 is defined by two faces 58, 60 that are mirror images of each other. First face 58 includes a first section 58*a*, a second section 58*b*, and a third section 58*c*. First section 58*a* is disposed substantially at right angles to lower surface 22*b* and parallel to each of first and second sides 22*c*, 22*d* of second member 22. Second section 58*b* preferably is disposed at an angle of about 60° relative to first section 58*a* although other angles are possible. Third section 58*c* is disposed substantially parallel to lower surface 22*c* and at right angles to first section 58*a*. Second face 60 has a first section 60*a* that corresponds to first section 58*a*; a second section 60*b* that corresponds to second section 58*b*; and a third section 60*c* that corresponds to third section 58*c*. Thus, third sections 58*c*, 60*c* are horizontally aligned with each other and second sections 58*b*, 60*b* flare outwardly away from each other. A divot 62 is defined between third section 58*c* and third section 60*c*. Third recess 46 is generally U-shaped in cross-section when viewed from one or the other ends of second member 22. This configuration enables the walls 64, 66 to flex slightly into third recess 46 when first and second protrusions 26, 28 are engaged in first and third recess 44, 48 and are removed therefrom.

Figure 3:
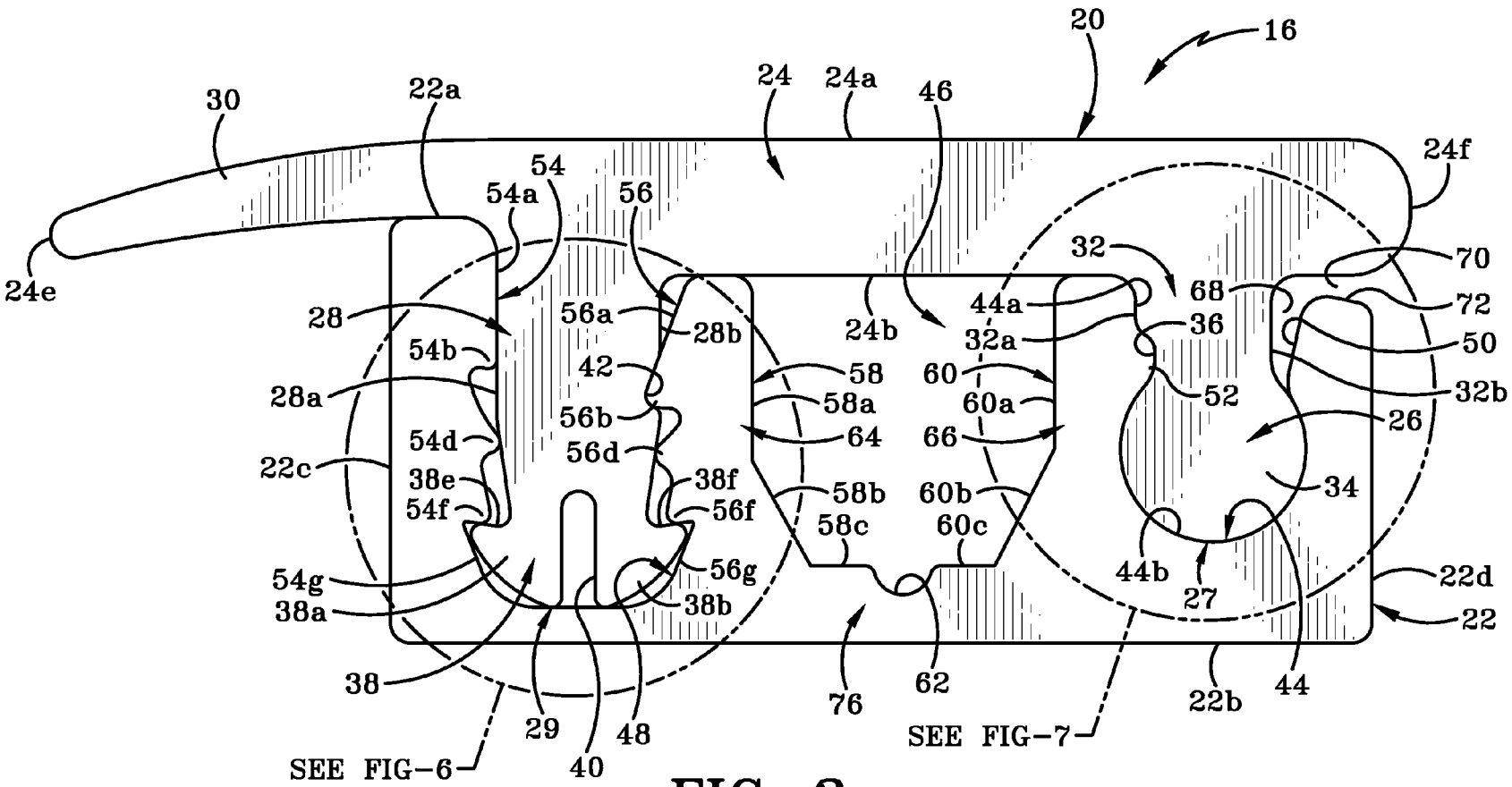
FIG. 3 is a side view of a first embodiment of the divider shown detached from the floor system of FIG. 2, and showing a first member and a second member thereof in an engaged position.

FIG. 3 shows first member 20 engaged with second member 22. As is evident from this figure, first protrusion 26 is received within first recess 44 in such a way that terminal end 34 substantially fully occupies channel 44*b*, and detent 52 on stem 32 is interlockingly engaged with notch 36. It should be noted that a first gap 68 is defined between face 50 and second side surface 32*b* of stem 32. A second gap 70 is defined between bottom surface 24*b* of base 24 and top end 72 of second member 22. Second protrusion 28 is engaged in second recess 48 such that first and second flanges 38*a*, 38*b* are disposed in the lowermost region 48*a* of second recess 48. Shoulders 38*e* and 38*f* are interlockingly engaged with second detents 54*f*, 56*e*.

Flooring system 10 including divider 16 is installed and used in the following manner. First and second flooring surfaces 12, 14 are installed on base surface 18 by any suitable known methods. A gap 72 (FIG. 2) is left between first and second flooring surfaces 12, 14. Preferably gap 72 is substantially complementary in size to the width "W" of second member 22. (Width "W" is measured between first and second sides 22*c*, 22*d*.) Second member 22 is then ready to be position within gap 72. When this is done, the installer must take notice of which of the two flooring surfaces 12, 14 is lower in height relative to base surface 18. Second member 22 is then oriented so that first side 22*c* is disposed adjacent the lower height flooring surface. In FIG. 2, for example, first flooring surface 12 is slightly lower in height relative to second flooring surface 14. First side 22*c* is therefore positioned adjacent first flooring surface 12. Fasteners 74 are inserted into third recess 46, and are screwed through a portion of wall 76, and into base surface 18. Fasteners 74 are screwed into base surface 18 at intervals along length "L" of second member 22. It will be understood that any suitable type of fastener may be used for this purpose. A fastener that is configured to be complementary to at least a portion of the shape of third recess 46 is particularly desirable. Still further, third recess 46 preferably is a counterbore hole so that fastener 74 is disposed either flush with or beneath the upper surface of second member 22. It will further be understood that any type of mechanism other than fasteners which is able to releasably secure second member 22 to base surface 18 may be utilized without departing from the scope of the present invention.

First member 20 is then snap-fittingly engaged with second member 22 by positioning first protrusion 26 in the mouth of first recess 44 and second protrusion 28 in the mouth of second recess 48. First member 20 is pushed downwardly in the direction of arrow "A" (FIG. 2) to cause first and second protrusions 26, 28 to move through first and third recesses 44, 48 until the bottom ends 27, 29 thereof reach the bottom ends of the associated recesses. When first member 20 is thus engaged with second member 22, flange 30 extends for a distance along the upper surface 12*a* of first flooring surface 12 and coverers any gap between edge 12*b* of flooring surface 12 and first side 22*c* of second member 22. First side 24*e* of first member 20 rests on upper surface 12*a* of first flooring surface 12 and retains first flooring surface 12 in place and prevents it from being lifted from base surface 18. Additionally, second side 24*f* of first member 20 projects for a short distance beyond first edge 14*a* of second flooring surface 14 and covers any gap between first edge 14*a* and second side 22*d* of second member 22. As shown in FIG. 2, because of the height of second flooring surface 14, second side 24*e* of first member 20 tends to abut first edge 14*a*. First member 20 projects for a small distance above the upper surfaces 12*a*, 14*b* of first and second flooring surfaces 12, 14 and provides a gently sloped and more aesthetically appealing transition between these two surfaces than would be the case if divider 16 was not used. Additionally, if the size of gap 72 between first and second floor surfaces 12, 14 is of an uneven width along its length, divider 16 hides this issue.

If at some later stage the first flooring surface 12, which is a rubber mat, must be removed for cleaning or for replacement, first member 20 may be quickly and easily disengaged to a sufficient degree to enable first flooring surface 12 to be lifted off base surface 18. This disengagement may be partial, such as in FIG. 8 or complete such as in FIGS. 4 and 5. If first member 20 of divider 16 becomes damaged then first member 20 would be completely detached from second member 22 and would be replaced with another first member.

Figure 8:
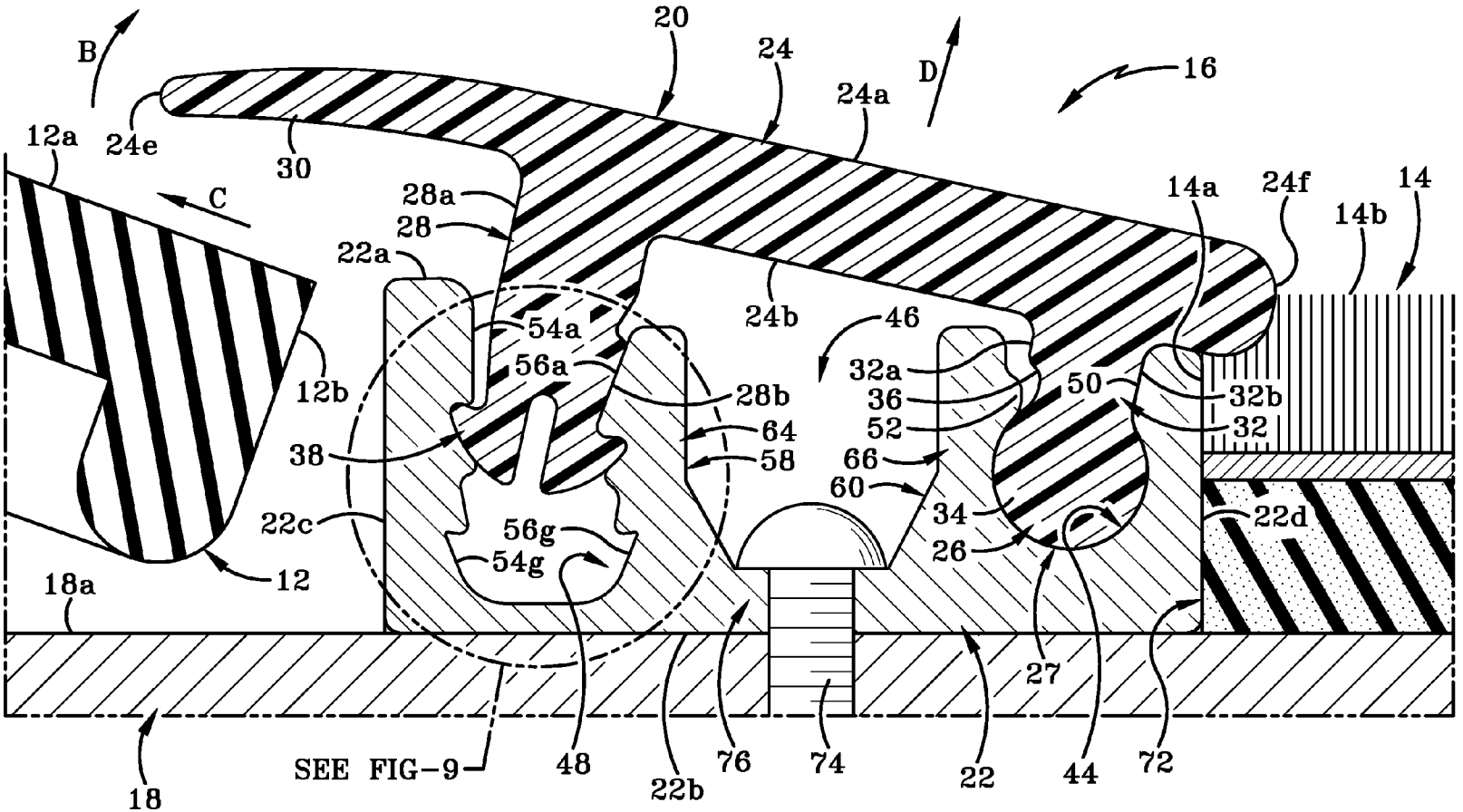
FIG. 8 is a cross-sectional side view of the floor system showing the divider moved to a disengaged position so that a floor mat may be removed from the system.
Figure 9:
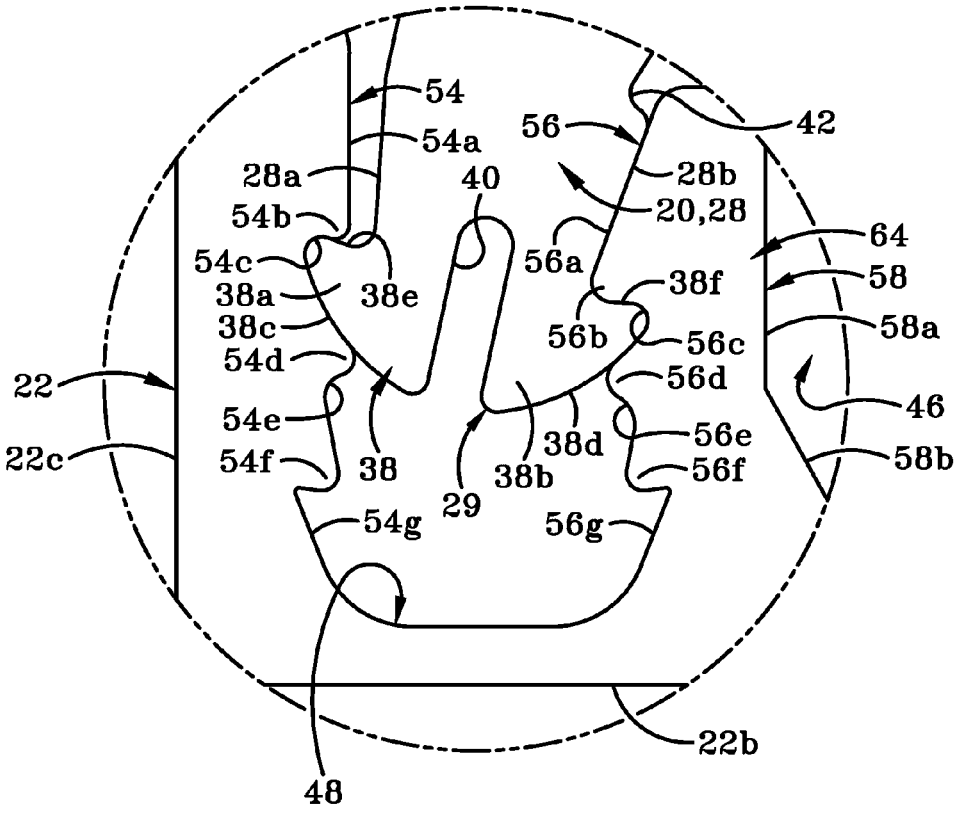
FIG. 9 is an enlarged cross-sectional side view of the highlighted region of FIG. 8.

The partial disengagement of first member 20 from second member 22 is shown in FIG. 8. This figure shows first member 20 rotated from a first position where it is substantially parallel to lower surface 22*b* of second member 22, to a second position where it is disposed at an angle relative thereto. The rotation is accomplished by engaging flange 30 and lifting it upwardly in the direction of arrow "B". This rotational or pivotal motion causes second side surface 32*b* of stem 32 on first protrusion 26 to move into engagement with face 50 and causes second side surface 28*b* of second protrusion 28 to move into engagement with face 56*a*. Rotation in the direction of arrow "B" also causes first and second flanges 38*a*, 38*b* on second protrusion 28 to progressively move from third notches 54*g*, 56*g* to second notches 54*e*, 56*e*, to first notches 54*c*, 56*c* (as shown in FIG. 9). As may be noted from FIG. 8, when first member 20 is rotated in the direction of arrow "B" the detent 52 on wall 66 becomes disengaged from notch 36. First member 20 is then retained at an angle relative to lower surface 22*b* and base surface 18. This angle is sufficient to permit first flooring surface 12 to be lifted from base surface 18 in the direction of arrow "C". A cleaned first flooring surface 12 or a new flooring surface (not shown) may then be positioned in the appropriate location on base surface 18 so that an edge thereof abuts first side 22*c* of second member 22. First member 20 is then snapped back into engagement with second member 22 by pushing it downwardly on a region generally above second protrusion 28. This downwardly directed force causes first member 20 to rotate in the opposite direction of arrow "B" until flange 30 on first member 20 comes to rest on the upper surface 12*a* of the cleaned first flooring surface 12. First flooring surface 12 is then substantially prevented from being disengaged from divider 16. FIG. 8 therefore shows divider 16 in an unlocked position and FIG. 2 shows divider 2 in a locked position.

If it is first member 20 itself which must be replaced, when second protrusion 28 disengages from second recess 48, first protrusion 26 may be easily withdrawn from first recess 44 by simply pulling first member 20 outwardly in a direction indicated by arrow "D" (FIG. 8). A replacement first member (not shown) may then be engaged with second member 22 in the same manner as described above with reference to first member 20. Second member 22 remains secured to base surface 18 at all times during these operations.

Figure 10:
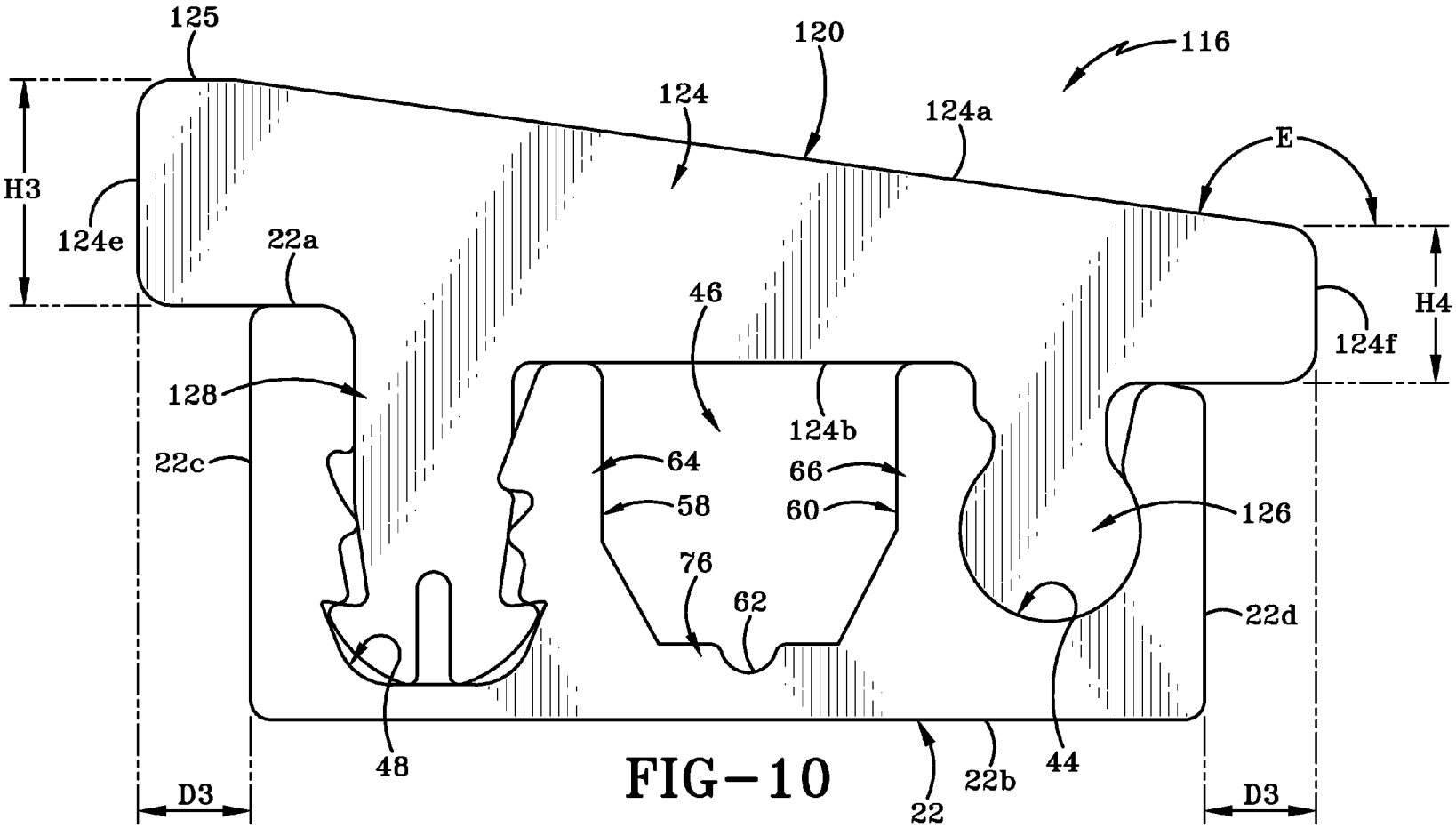
FIG. 10 is a side view of second embodiment of a divider in accordance with the present invention.

FIG. 10 shows a second embodiment of a divider that may be utilized in a floor system in accordance with the present invention. The second embodiment of the divider is indicated by reference number 116. Divider 116 includes a third member 120 and the second member 22. Second member 22 is the identical member to that used in divider 16. Third member 120 is configured to matingly engage second member 22 when first member 20 is detached therefrom. This scenario would occur if there is a need to transition between two flooring surfaces other than first and second flooring surfaces 12, 14. So, for example, second flooring surface 14 is disposed on one side of divider 116 and a flooring surface (not shown) other than first flooring surface 12 is disposed on the opposite side of divider 116. Divider 116 may be used when there is a greater height differential between the two flooring surfaces. In this instance, since second member 22 is permanently secured to base surface 18, first member 20 is disengaged from second member 22 and is replaced by third member 120.

In accordance with a specific feature of the present invention, divider 116 includes a base 124 that differs in cross-sectional shape from that of base 24. Base 124 has an upper surface 124*a*, a lower surface 124*b*, a first and second end (not shown), a first side 124*e*, and a second side 124*f*. A first protrusion 126 and a second protrusion 128 extend outwardly away from lower surface 124*b*. First protrusion 126 is substantially identical to first protrusion 26 and second protrusion 128 is substantially identical to second protrusion 28 in both structure and function. Base 124 is substantially wedge-shaped in cross-section with first side 124*e* being of a height "H3" and second side 124*f* being of a second height "H4". The majority of upper surface 124*a* (except for region 125) is disposed at an angle "E" relative to lower surface 124*b*. Additionally, a portion of lower surface 124*b* extends beyond each of first and second sides 22*c*, 22*d* of second member 22 for about the same distance "D3". Thus, the portions of lower surface 124*b* overhang regions of the base surface (not shown) to which second member 22 is secured. An edge region of each of the flooring surfaces disposed over the regions of the base surface will therefore be partially covered by those overhanging portions of lower surface 124*b*. Thus, divider 116 covers the edges of the two flooring surfaces and makes the transition between them more aesthetically appealing. The engagement of third member 120 with second member 22 and the disengagement therefrom is substantially identical to the engagement and disengagement of first and second members 20, 22.

It will be understood that the cross-sectional configuration of the first member 20 or third member 120 may be altered to suit any pair of flooring surfaces that may be incorporated into a floor system. Thus, the first member may have different cross-sectional shapes from those shown in FIGS. 2 and 10 without departing from the scope of the present invention. Additionally or alternatively, differently configured first and second protrusions 26, 28, 126, 128 may be provided on the first member and complementary configured first and third recesses 44, 48/44, 48 may be defined in the second member 22/22 without department from the scope of the present invention. Furthermore, portions of the first member may overhang sides 22*c*, 22*d*/22*c*, and 22*d* of second member 22/22 to varying degrees and in different ways without departing from the scope of the present invention.

It will further be understood that flooring system 10 may include a divider kit comprised of a plurality of differently configured first members that are provided in combination with one single second member. This kit will enable an installer to select the most appropriate one of the differently configured first members for a particular flooring solution. Thus, in accordance with the present invention the flooring system 10 includes:

a first flooring surface 12 that is positioned upon a base surface 18;

a second flooring surface 14 positioned on base surface 18 in end-to-end relationship with first flooring surface 12 and separated therefrom by a gap 72; and a divider kit for transitioning gap 72 between first and second flooring surfaces 12, 14; and wherein the kit comprises:

a plurality of first members 20, 120, each of first members 20, 120 having a different cross-sectional shape;

a second member 22 adapted to be secured to base surface 18; wherein one of the plurality of first members 20, 120 is selected for engagement with second member 22 to suit first and second flooring surfaces 12, 14 to be installed on base surface 18; and wherein the selected one of first members 20, 120 is releasably securable to second member 22 and is rotatable between a first position where it is disposed substantially parallel to a lower surface 22*b* of second member 22, and a second position where it is disposed at an angle relative to lower surface 22*b* of second member 22.

It will further be understood that the first and second members 20, 22/120, 22 may be made of the same material or may be made from different materials. For example, both of the first and second members may be made from plastic or metal, or, one of the first and second members may be made from plastic and the other from metal, without departing from the scope of the present invention. Preferably, second member 22 is manufactured from a metal, such as extruded aluminum, and first member 20/120 is manufactured from extruded vinyl. The second member 22 preferably is made from metal as this material is more durable than other materials.

It will be understood that when divider 16/116 has been installed on base surface 18 it may be a permanent fixture and does not need to be rotatable. Second embodiment of divider, i.e., divider 22 is of this type of configuration. Divider 22 can, however, be rotated by applying an upward force on the region of first member 120 overhanging first side 22*c* of second member.

It will further be understood that while dividers 16/116 have been described as being used for transitioning between a first flooring surface and a second flooring surface, dividers 16/116 may be used in many applications where a transition between adjacent first and second substantially planar surfaces is needed. For example, dividers 16/116 may be used as transitions between two wall coverings between two fabric coverings, without departing from the scope of the invention.

It will further be understood that the protrusions 26, 28 may be formed on the upper surface of the second member 22 and the complementary recesses 44, 48 be defined in the lower surface of the first member 20 without departing from the scope of the invention. In this latter instance the third recess 46 would remain defined in the second member 22 and between the two protrusions as the third recess 46 receives a fastener 74 to secure the second member 22 to base surface 18.

It will be still further understood that while it has been disclosed herein that the first member is rotatable between a first position where it is disposed substantially parallel to a lower surface of the second member, and a second position where it is disposed at an angle relative to the lower surface of the second member, the first member may be rotated through three or more positions relative to the lower surface of the second member. At each additional position, the first member will be disposed at a different angle relative to the lower surface of the second member. These additional positions of the first member could be utilized to accommodate a variety of different thickness first and second surfaces.

Figure 11:
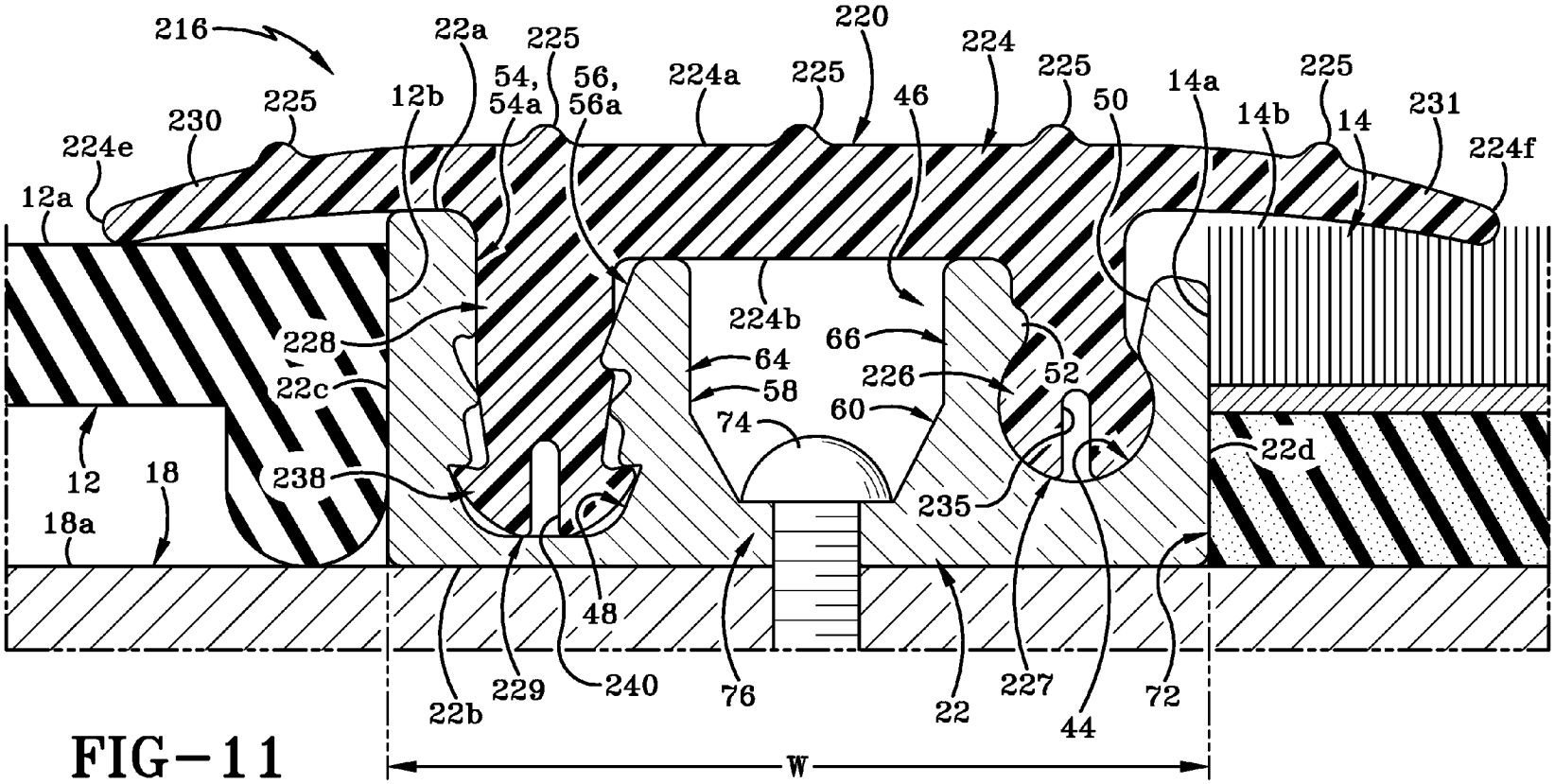
FIG. 11 is a cross-sectional side view of a floor system including a third embodiment of a divider in accordance with an aspect of the present invention.

Referring to FIG. 11 there is shown a floor system which includes a third embodiment of a divider in accordance with an aspect of the present invention, generally indicated at 216. Divider 216 is substantially identical to divider 16 in that it is configured to span the gap between two different flooring surfaces 12 and 14.

Divider 216 comprises a first member 220 and a second member that preferably are snap-fittingly and releasably engageable with each other in much the same manner as divider 16. The second member of divider 216 is identical to divider 22 and is thus numbered accordingly. No further description or explanation will be provided as relating to this second member.

First member 220 is an elongate member that is similar in appearance from above to first member 20 as shown in FIG. 1. First member 220 includes an elongate base 224, a first protrusion 226, and a second protrusion 228. Base 224 has a top surface 224*a*, a bottom surface 224*b*, a first end and a second end (not shown in FIG. 11 but substantially identical to first and second ends 24*c*, 24*d*), a first side 224*e* and a second side 224*f*. The first and second ends of the base 224 form the first and second ends of first member 220.

In accordance with a first aspect of the invention, base 224 includes a base region of a first thickness "T3" which extends between first and second protrusions 226, 228 and terminates generally in alignment with their outermost surfaces (i.e., the respective surfaces closest to first and second sides 224*e*, 224*f*). The portion of base 224 disposed between first protrusion 226 and second side 224*f* is thinner than the thick base region and comprises a first arm 231 on base 224. The portion of base 224 disposed between second protrusion 228 and first side 224*e* is substantially identical in appearance to the first ami 231 and comprises a second arm 230 on base 224.

By way of explanation, the components 231, 230 being referred to in this portion of the description as "arms" were previously referred to in this specification as "flanges" ® such as flanges 30, 31, 130 and 131. It will be understood that whether the term "arm" or "flange" is utilized when discussing the components 31, 30, 131, 130, 231, 230, or 331, 330 (following)—the component still performs the same function of holding down the adjacent flooring surface 12, 14 and hiding the join between the flooring surface and the divider. In particular, if any screws or the like or aluminum edge pieces are present at the edges of the flooring surfaces 12, 14, then the dividers 16, 116, 216 and, and will be described later herein 316, aid in hiding those screws or edge pieces, and thereby present a more aesthetically pleasing end product.

It should be noted that the components 231, 230 are referred to in this latter portion of the described as "arms" in order to more clearly distinguish them from the flanges at the terminal ends of first and second protrusion 226, 228.

The first and second arms 231, 230 extend outwardly from the thicker region in opposite directions to each other. First and second arms 231, 230 are also oriented generally at right angles to first and second protrusions 226, 228. Furthermore, first and second arms 231, 230 are of a substantially identical length to each other and taper from the thicker base region to the thinner first and second sides 224*f*, 224*e*.

In accordance with another aspect of the invention, at least one and preferably several ridges 225 are provided on top surface 224*a* of base 224. Ridges 225 preferably are disposed spaced apart and substantially parallel to each other and are provided both on the thicker part of base 224 and on the first and second arms 231, 230 thereof. Ridges 225 provide a gripping surface or tread on divider 216. It will be understood that instead of being spaced apart and parallel, ridges 225 may be in any other desired pattern or configuration that will provide the desired gripping surface or tread on first member 220.

First protrusion 226 and second protrusion 228 extend outwardly away from bottom surface 224*b* of base 224 and are spaced laterally from each other along bottom surface 224*b*. First and second protrusions 226, 228 are generally parallel to each other and are disposed at right angles to bottom surface 224*b* of base 224.

First protrusion 226 is similar to first protrusion 26 in that it is spaced inwardly from second side 224*f* of base 224 and includes a stem 232 and a terminal end 234. Stem 232 extends outwardly from bottom wall 224*b* of base 224 and terminal end 234 is disposed remote from bottom wall 224*b*. Stem 232 is substantially identical in structure to stem 32 and functions in the same manner. Terminal end 234 has a curved peripheral surface and first member 220 pivots on this curved surface when it is moved between the first and second positions in the same manner as described with reference to first member 20. Preferably, terminal end 234 is generally circular in cross-sectional shape and the diameter of terminal end 234 is greater than the width of stem 232. Terminal end 234 differs from terminal end 34 in that it defines a slot 235 therein. Slot 235 therefore effectively divides terminal end 234 into two flanges which are able to flex somewhat relative to each other as divider 216 is used. The presence of slot 235 therefore makes it easier to insert first protrusion 226 into first aperture 44 and to rotate terminal end 234 therein during use of first member 220.

Second protrusion 228 is substantially identical in structure and function to second protrusion 28. Second protrusion terminates in a tip 238 which defines a slot 240 therein. Tip 238 is comprised of first and second flanges which are substantially identical to first flange 38*a* and second flange 38*b*. Slot 240 is defined between the first and second flanges and this slot 240 is oriented substantially at right angles to lower surface 224*b* of base 224. It should be noted that slot 235 in first protrusion 226 is substantially parallel to slot 240. Slots 235 and 240 are aligned with the longitudinal axis of first member (where the longitudinal axis extends between the first and second ends of first member 220).

In accordance with an aspect of the invention, second protrusion 228 has a length measured from lower surface 224*b* of the base region of base 224 to a bottom 229 of the free end of second protrusion 228. Each of the first and second arms 231, 230 is of approximately the same length where their length is measured from where they join the base region of base 224 to their respective outermost tips (which coincide with first and second sides 224*e*, 224*f*). It will be understood that the arms join the base region generally in the area that aligns with the outermost surfaces of first and second protrusions 226, 228. In accordance with an aspect of the invention, the length of each of first and second arms 231, 230 is approximately equal to the length of second protrusion 228. Furthermore, when first member 220 is engaged with second member 222, approximately three-quarters of the length of each of first and second arms 231, 230 extends beyond a respective side 22*d*, 22*c* of second member 22.

First member 220 is used in substantially the same manner as first member 20 except that when first member 220 is engaged in second member 222, the first arm 231 extends for a distance over upper surface 14*b* of second flooring surface 14 and beyond the edge 14*a* thereof. Furthermore, first arm 231 extends for a substantial distance beyond second side 22*d* of second member 22. This distance is only slightly smaller than the overall length of first arm 231 as measured between first protrusion 226 and second side 224*f*. In the first embodiment of divider 16, the second side 24*f* of first member 20 is more-or-less vertically aligned with second side 22*d* of second member 22.) First arm 231 therefore extends further over the upper surface 14*b* of second flooring surface 14 and beyond the edge 14*a* thereof than is the case with divider 16. This difference in first member 220 makes for a more gentle transition between second flooring surface 14 and divider 216.

In a similar fashion, first arm 230 of divider 216 extends for a distance over the upper surface 12*a* and beyond edge 12*b* of first flooring surface 12. First arm 230 therefore extends for a distance that approximates its entire length beyond first edge 22*c* of second member 22. The length of first arm 230 also makes the transition between divider 216 and first flooring surface 12 more gentle.

Figure 12:
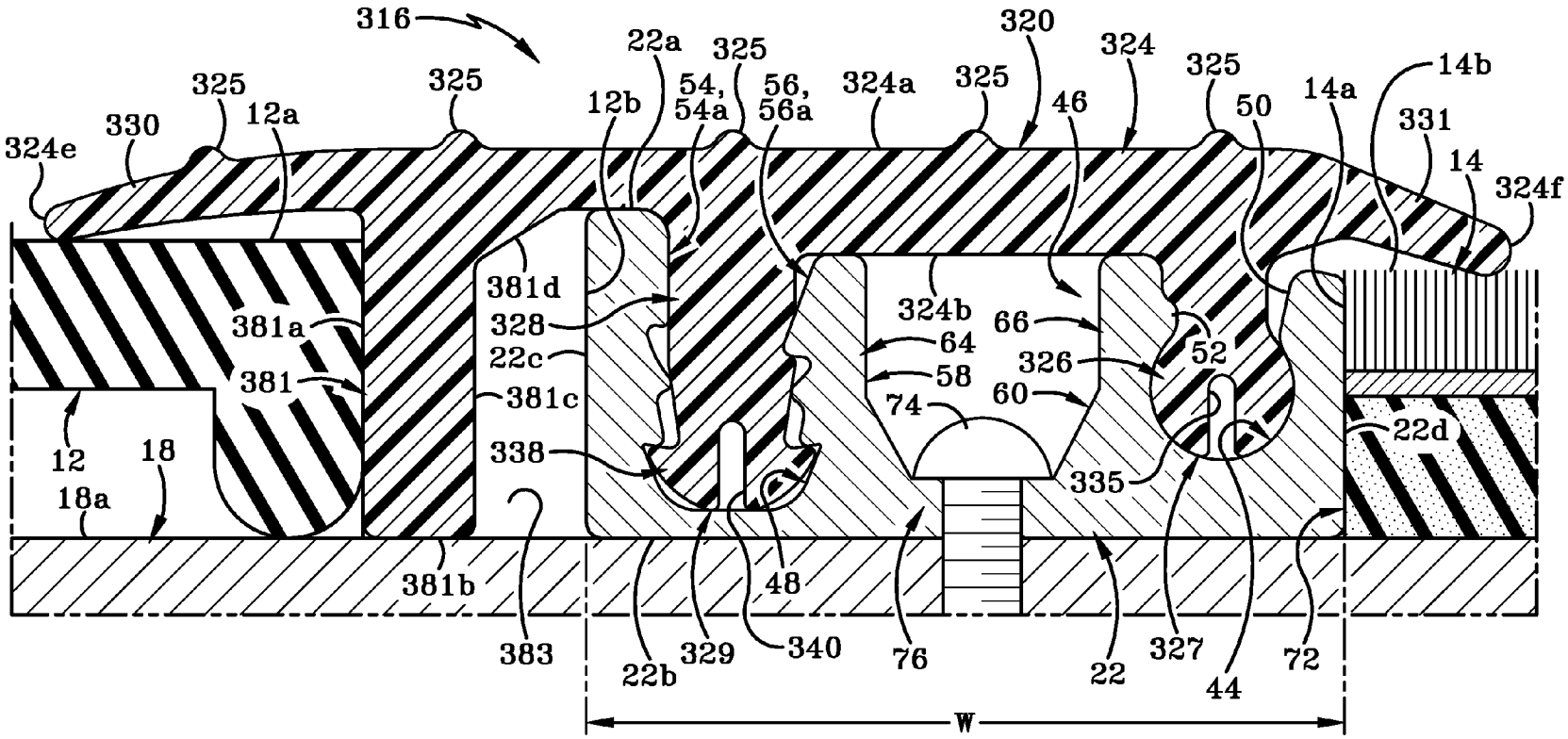
FIG. 12 is a cross-section side view of a floor system including a fourth embodiment of a divider in accordance with an aspect of the present invention.

FIG. 12 illustrates a third embodiment of a divider in accordance with an aspect of the invention. The third embodiment divider is indicated by the reference number 316. Divider 316 includes a first member 320 and a second member 22 that again are snap-fittingly and releasably engageable with each other in much the same manner as divider 16. Second member 22 is substantially identical to the second members shown in FIGS. 2 and 11 and functions in the same manner. First member 20 includes a base 324 which has an upper surface 324*a*, lower surface 324*b*, first and second ends (not shown but substantially identical to first and second ends 24*c*, 24*d*), and first and second sides 324*e*, 324*f*. A first protrusion 326 and a second protrusion 328 extend outwardly from lower surface 324*b* and engage second member 22. First protrusion 326 is substantially identical in structure and function to first protrusion 226 and second protrusion 328 is substantially identical in structure and function to second protrusion 228.

First member 320 further includes a second arm 331 which extends between from base 324 in a first direction outwardly from first protrusion 326. Second arm 331 angles downwardly from a thicker region of base 324 (which extends between first and second protrusions 326, 328). Preferably second arm 331 is disposed at an angle of about 45° relative to upper surface 324*a* of the thicker region of base 324. When divider 316 is positioned between a first flooring surface 12 and a second flooring surface 14, the terminal end of second arm 331, i.e., second end 324*f*, contacts upper surface 14*b* of second flooring surface 14. First arm 331 extends for a distance beyond second edge 22*d* of second member 22 and for a distance beyond edge 14*b* of second flooring surface 14.

In accordance with an aspect of the invention; first arm 230 is substantially longer than second arm 331. A supporting leg 381 extends downwardly from bottom surface 324*b* of base, and particularly from the lower surface thereof. Preferably, leg 381 is disposed intermediate second protrusion 328 and end 324*e* of first arm 230. In particular, leg 381 is disposed a first distance from second protrusion 328 and a second distance from end 324*e*. Most particularly, the first and second distances are substantially equal and leg 381 is positioned approximately in the middle of the length of first arm 230. In other words, supporting leg 381 is approximately equidistant between second protrusion 328 and first side 324*e* of base 324.

Leg 381 has a peripheral side wall with an exterior surface 381*a* and an interior surface 381*c*. Leg 381 also has a bottom end 381*b*. It should be noted that leg 381 is separated from second protrusion 328 by a gap 383. A bracing wall section 381*d* angles upwardly from the interior surface 328*c* of the side wall of leg 381 and toward lower surface 324*b* of first arm 330. This wall section 381*d* acts as a supportive brace and aids in preventing leg 38*a* from buckling when downward force is brought to bear upon the region of base 324 above leg 381. Wall section 381*d* also reduces the tendency of leg 381 to rotate inwardly toward second protrusion 328. Preferably, the angle of wall section 381*d* is approximately 45° relative to each of interior surface 328*c* and lower surface 324*b*. It will be understood, however, a wall section 381*d* disposed at any angle other than 45° may be utilized, provided the angle selected will enable wall section 381*d* to provide sufficient strength to leg 381 and second arm 330 to enable them to perform their functions adequately.

It should further be noted that leg 381 is longer than second protrusion 328, which in turn is longer than first protrusion 326. Preferably, leg 381 is long enough that when first member 320 is engaged with second member 322, bottom end 381*b* of leg 381 is substantially aligned with bottom surface 22*b* of second member 22. Thus, bottom end 381*b* of leg 381 is able to rest on upper surface 18*a* of base surface 18 and is aligned with bottom surface 22*b* of second member 22 thereon. This configuration ensures that base 324 is adequately supported above base surface 18 from first side 324*e* through to second side 324*f*.

First member 320 further includes one or more ridges 325 which are substantially parallel to each other and spaced apart from each other. Ridges 325 are substantially identical to ridges 225 and provide a gripping surface or tread on divider 316.

Divider 316 is particularly useful in situations where there is a substantial gap between the edges of the first and second floor surfaces 12, 14. Divider 316 is used to span this gap. In this instance, second member 22 is secured to base surface 18 as has been previously described and first member 320 is interlockingly engaged with second member 22. Leg 381 extends downwardly into a gap between edge 12*b* of first flooring surface 12 and first edge 22*c* of second member 22. Edge 12*b* of first flooring surface 12 preferably abuts exterior surface 381*a* of leg 381 although it can be situated between exterior surface 381*a* and a short distance inwardly from first side 324*a* of first arm 330. Divider 316 is able to be disengaged from base surface 18 as previously described with reference to divider 16.

In accordance with the present invention, it should be noted that the upper surface 324*a* of the region of base member 324 which extends between first and second protrusions 326, 328 and between second protrusion and leg 328, 381 is substantially planar and horizontal. First and second arms 330, 331 angle downwardly away from this horizontal region. Furthermore, bottom end 381*b* of leg 381 rests upon base surface 18 not upon first flooring surface 12.

Certain modifications to dividers 316 and 216 are possible. For example, divider 316 could be modified so that second ami 331 is substantially identical to first arm 330 (i.e. so that the first and second arm arrangement is similar to divider 216); and then a leg similar to leg 381 (but a mirror image thereof) disposed on second arm 331. This modified divider could then be used to span an even larger gap between first and second flooring surfaces 12, 14 with the two spaced apart legs providing support to the first and second arms. Again, if modified in this way, the second leg would be of a similar length to leg 381 and therefore be longer than both of the first and second protrusions and directly contact the base surface upon which second member 22 is secured.

It will further be understood that while the third embodiment of the invention is illustrated as having a first protrusion 326 that defines a slot 325 therein, the first protrusion may instead be identically configured to the first protrusion 26.

It will further be understood that first and second members 220, 22 and 320, 22 snap fittingly engage each other and that first members 220 or 320 are able to pivot relative to second members 22 on the curved surfaces of the terminal end of respective first protrusion 226 or 326. Still further, the second recess 48 in both of these systems defines notches therein and in which the flanges of the second protrusion 228, 328 engage, as is described with reference to the notches and flanges utilized in divider 16.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention are an example and the invention is not limited to the exact details shown or described.

The invention claimed is:

1. A divider for transitioning between a first surface and a second surface disposed in end-to-end relationship upon a base surface; said divider comprising:

a first member having a base region with a lower surface;

a second member adapted to be secured to the base surface between the ends of the first and second surfaces;

a first recess and a second recess defined in an upper surface of the second member, said first and second recesses being spaced apart from each other;

a first protrusion and a second protrusion extending outwardly from the lower surface of the base region of the first member; wherein the first protrusion is engageable in the first recess and the second protrusion is engageable in the second recess so as to releasably secure the first and second members together; and wherein each of the first protrusion and the second protrusion includes a terminal end and the terminal end of the first protrusion is differently shaped to the terminal end of the second protrusion and wherein the terminal end of the first protrusion is generally circular in cross-section and the terminal end of the second protrusion is generally T-shaped in cross-section; and wherein the second protrusion includes a stem with side walls and the terminal end of the second protrusion extends downwardly from the stem and includes a first flange and a second flange which are generally parallel to the stem and a slot is defined between the first and second flanges which is also generally parallel to the stem; and wherein the first flange includes a first shoulder which extends outwardly beyond the associated side wall of the stem in a first direction; and the second flange includes a second shoulder which extends outwardly beyond the associated side wall of the stem in a second direction.

2. The divider as defined in claim 1, wherein the first and second shoulders are oriented generally at right angles to the side walls of the stem.

3. The divider as defined in claim 1, wherein an interior surface of the second member defining the second recess includes a plurality of differently oriented and configured notches and detents formed therein; and wherein the first and second shoulders are engageable within any selected ones of the notches.

4. The divider as defined in claim 1, wherein the first member further includes:

a first arm which extends outwardly from the base region of the first member in a first direction; wherein the first arm is disposed generally at right angles to each of the first and second protrusions.

5. The divider as defined in claim 4, further comprising:

a second arm extending outwardly from the base region of the first member in a second direction opposite to the first direction; and wherein the second arm is disposed generally at right angles to each of the first and second protrusions.

6. The divider as defined in claim 5, wherein each of the first and second arms is of approximately a same length; where the length is measured from the base region to a free end of the respective arm.

7. The divider as defined in claim 6, wherein the second protrusion has a length measured from the lower surface of the base region to a bottom of the free end of the second protrusion; and wherein the length of each of the first and second arms is approximately equal to the length of the second protrusion.

8. The divider as defined in claim 7, wherein approximately three-quarters of the length of each of the first and second arms extends beyond a side of the second member when the first member is engaged with the second member.

9. The divider as defined in claim 6, wherein the base region of the first member is of a first thickness and the first and second arms are thinner than the base region and taper outwardly therefrom.

10. The divider as defined in claim 1, further comprising one or more ridges extending outwardly from an upper surface of the first member.

11. The divider as defined in claim 1, wherein the terminal end of the first protrusion includes a first flange and a second flange and a slot which is defined between the first and second flanges.

12. A divider for transitioning between a first surface and a second surface disposed in end-to-end relationship upon a base surface; and divider comprising:

a first member including a base region and a first arm and a second arm extending outwardly from opposite sides of the base region;

a second member adapted to be secured to the base surface between the ends of the first and second surfaces;

a first recess and a second recess defined in an up er surface second member, said first and second recesses being spaced apart from each other;

a first protrusion and a second protrusion extending outwardly from a lower surface of the base region of the first member; wherein the first protrusion is engageable in the first recess of the second member and the second protrusion is engageable in the second recess thereof to releasably secure the first and second members together; and wherein each of the first protrusion and the second protrusion includes a terminal end and the terminal end of the first protrusion is differently shaped to the terminal end of the second protrusion; wherein the terminal end of the first protrusion includes a first flange and a second flange and a first slot which is defined between the first and second flanges; and a leg extending downwardly from a lower surface of one of the first and second arms of the first member, said leg being disposed intermediate the second protrusion and an end of the one of the first and second arms; and wherein the second protrusion includes a stem with side walls and the terminal end of the second protrusion extends downwardly from the stem and includes a first flange and a second flange which are generally parallel to the stem and a second slot is defined between the first and second flanges which is also generally parallel to the stem; and wherein the first flange includes a first shoulder which extends outwardly beyond the associated side wall of the stem in a first direction; and the second flange includes a second shoulder which extends outwardly beyond the associated side wall of the stem in a second direction.

13. The divider as defined in claim 12, wherein the first and second shoulders are oriented generally at right angles to the side walls of the stem.

14. The divider as defined in claim 12, wherein an interior surface of the second member defining the second recess includes a plurality of differently oriented and configured notches and detents formed therein; and wherein the first and second shoulders are engageable within any selected ones of the notches.

15. The divider as defined in claim 12, wherein the leg is disposed a first distance away from the second protrusion and a second distance away from the end of the one of the first and second arms.

16. The divider as defined in claim 15, wherein the first and second distances are substantially equal.

17. The divider as defined in claim 12, wherein the leg is disposed substantially parallel to the first and the second protrusions.

18. The divider as defined in claim 12, wherein the leg has a length as measured from the lower surface of the one of the first and second arms to a bottom end of the leg; and each of the first and second protrusions has a length as measured from the lower surface of the base region through to a bottom of a free end of the respective protrusion; and wherein the length of the leg is greater than the length of either of the first and second protrusions.

19. The divider as defined in claim 12, further comprising a bracing wall extending between a side wall of the leg and the lower surface of the one of the first and second arms; and wherein the bracing wall is disposed at an angle relative to the side wall of the leg and to the lower surface of the one of the first and second arms.

20. The divider as defined in claim 12, wherein the first arm is disposed at an angle of approximately 45 degrees relative to the base region of the first member; and wherein the second arm is disposed generally at right angles to the first and second protrusions; and the leg extends downwardly from the lower surface of the second arm.

21. The divider as defined in claim 12, further including a ridge extending outwardly from an upper surface of the base member.

22. The divider as defined in claim 12, wherein the first member is rotatable between a first position where it is disposed substantially parallel to a lower surface of the second member, and a second position where it is disposed at an angle relative to the lower surface of the second member.

23. The divider as defined in claim 12, wherein the first flange extends outwardly from a free end of the first protrusion in a first direction and the second flange extends outwardly from the free end of the first protrusion in a second direction; and wherein the first and second flanges flex inwardly into the first slot and toward each other when the first protrusion is inserted into the first recess or is partially or completely withdrawn therefrom.

24. The divider as defined in claim 23, wherein the first flange extends outwardly from a free end of the second protrusion in a first direction and the second flange extends outwardly from the free end of the second protrusion in a second direction; and wherein the first and second flanges of the second protrusion flex inwardly into the second slot and toward each other when the second protrusion is inserted into the second recess or is partially or completely withdrawn therefrom.

25. The divider as defined in claim 24, further comprising:

a first notch defined in a wall of the second member which defines the second recess; wherein the first flange of the second protrusion is received in the first notch; and a second notch defined in the wall which defines the second recess; and wherein the second flange of the second protrusion is received in the second notch.

26. The divider as defined in claim 12, further comprising a third recess defined in the second member and disposed between the first and second recesses; and a fastener; and wherein the fastener is disposed within the third recess and is adapted to secure the second member to the base surface.

27. The divider as defined in claim 12, wherein the terminal end on the first protrusion is substantially circular in cross-section, and wherein the first recess includes a region complementary to the terminal end; and the first member is pivotable on the terminal end of the first protrusion.

28. The divider as defined in claim 12, wherein the terminal end of the first protrusion is generally circular in cross-section and the terminal end of the second protrusion is generally T-shaped in cross-section.

* * * * *

UNITED STATES PATENT AND TRADEMARK OFFICE

CERTIFICATE OF CORRECTION

PATENT NO. : 8,966,847 B2
APPLICATION NO. : 14/046053
DATED : March 3, 2015
INVENTOR(S) : Kessler et al.

It is certified that error appears in the above-identified patent and that said Letters Patent is hereby corrected as shown below:

In the Claims

Column 16, line 67 (Claim 12) change “and divider comprising” to --said divider comprising--

Column 17, line 6 (Claim 12) change “an up er surface” to --an upper surface--

Column 17, line 7 (Claim 12) change “second member” to --of the second member--

Signed and Sealed this
Sixteenth Day of June, 2015

Michelle K. Lee

Michelle K. Lee
*Director of the United States Patent and Trademark Office*